United States Patent [19]

Vallomy

[11] Patent Number: 4,564,388

[45] Date of Patent: Jan. 14, 1986

[54] METHOD FOR CONTINUOUS STEELMAKING

[75] Inventor: John A. Vallomy, Charlotte, N.C.

[73] Assignee: Intersteel Technology, Inc., Matthews, N.C.

[21] Appl. No.: 720,225

[22] Filed: Apr. 5, 1985

Related U.S. Application Data

[63] Continuation-in-part of Ser. No. 636,944, Aug. 2, 1984.

[51] Int. Cl.[4] ..... C21C 7/00

[52] U.S. Cl. ..... 75/12; 75/46

[58] Field of Search ..... 75/46, 12, 44 S

[56] References Cited

U.S. PATENT DOCUMENTS

| | | | |
|---|---|---|---|
| 3,880,648 | 4/1975 | Forrest | 75/46 |
| 4,007,034 | 2/1977 | Hartwig | 75/46 |
| 4,419,128 | 12/1983 | Nakagawa | 75/46 |
| 4,456,476 | 6/1984 | Sherwood | 75/46 |

*Primary Examiner*—Peter D. Rosenberg

*Attorney, Agent, or Firm*—Ralph H. Dougherty

[57] ABSTRACT

A method for the continuous operation of an electric steelmaking furnace, including preheating charge materials, charging and tapping while maintaining full electric power, and having good control over both quality and product chemistry.

23 Claims, 3 Drawing Figures

METHOD FOR CONTINUOUS STEELMAKING

CROSS REFERENCE TO RELATED APPLICATION

This application is a continuation-in-part of application Ser. No. 636,944 filed Aug. 2, 1984, which is copending herewith.

BACKGROUND OF THE INVENTION

This invention relates to the continuous melting of a metallic charge to form a molten steel product. The process is particularly advantageous in those regions where there is a concentration of production of, or ready availability of scrap and/or direct reduced iron (DRI), and where electric energy is both available and economical.

Heretofore, the operation of an electric arc steelmaking furnace has been an intermittent operation, wherein the sequence followed is: charging of steel scrap and/or direct reduced iron, pig iron, slag formers and alloying elements; ignition or establishment of an electric arc between the electrodes in the furnace to create melting conditions for melting the charge and forming a molten metal bath covered by a molten slag; refining for a period of time during which the molten metal portion of the bath is refined to form steel having a desired composition and quality; and periodically raising the electrodes to remove them from contact with the bath and interference with the tapping procedure; and then tapping the molten metal. In addition, slag can be removed by a slagging, or slag-off, operation as required.

Electric steelmaking technology has been undergoing radical changes for the past twenty years. The success of ladle refining for normal steel quality requirements and secondary refining for high quality requirements have increased furnace productivity, and are influencing furnace design and operation.

Between fifteen and twenty years ago, the time consuming double slag practice was replaced by rapid metallurgy, resulting in some operations having power on during up to 70 percent of the tap-to-tap time, and 70 percent of the power-on time operating at full transformer capacity.

A short time later, a productivity of one metric ton of cast steel per MVA/hour was achieved by utilizing the ultra-high power concept. However, this productivity level is still a goal for most electric steelmakers. More recently, a few steelmakers have attained a productivity of about 1.8 metric tons of cast steel per MVA/hour by combining ultra-high power with scrap preheating, oxygen lancing, oxy-fuel burners, and ladle metallurgy. Tap to tap time ranges from about 60 to 80 minutes and a somewhat unstable equilibrium is reached with both the cycles of the furnace and the caster. Even today, there is still an unstable equilibrium, because it is reached under optimum conditions of furnace operation with only minimal allowance for the many unpredictables of batch furnace operation. Thus, long sequential casting from the EAF into a continuous caster is not a common practice, but the exception.

I have invented a better method of operating an electric arc steelmaking furnace, which incorporates continuous preheating, feeding and melting, and results in an increase in quality and productivity, and reduced operating costs. This method results also in a truly continuous operation of the caster, thus insuring a continuous output of cast steel during the whole refractory campaign of the furnace. Therefore the invention could be characterized as a method for continuous steelmaking.

Although the present invention is shown and described in connection with an electric arc steelmaking furnace, it will be readily apparent that any electric powered steelmaking furnace including but without limitation, plasma furnaces and induction furnaces could be substituted for the electric arc steelmaking furnace with like results.

There is currently a steelmaking practice known as "continuous charging" or "continuous melting", but these practices refer to a charging practice in which charge materials are fed to a furnace during the charging, melting and refining periods, then charging is interrupted and power input is interrupted for the tapping procedure. It has been found that an electric steelmaking furnace can be operated continuously without interruption of charging or power input for the tapping procedure by the taking the following steps in the steelmaking process.

First, if the furnace is of a small size, scrap must be prepared by shredding or shearing it to a suitable size. The scrap is preferably segregated for quality control. Segregation of scrap eliminates or limits undesirable elements, and classifies and makes available valuable alloy constituents. For example, copper is a strong contaminent in deep drawing steels, but is a desirable addition for weathering steels such as COR-TEN steel (see Making, Shaping and Treating of Steel, page 572–73, 9th edition, 1971). As received, the scrap is segregated into desired classifications, preferably depending on contamination by tramp elements sulfur and phosphorus. Segregated scrap is shredded or sheared and stored for use. By maintaining a stock of shredded or sheared raw material, continuous operation of the process is assured during periods of shredder or shear down-time.

Although prepared scrap is mandatory for small furnaces, commercial scrap can be fed to medium and large furnaces without preparation. The requirement for shredded or sheared scrap is strictly related to the furnace size. Furnaces of 3 meter diameter or smaller (small furnaces) require scrap of a maximum longest dimension of about one foot (0.3 meter). Furnaces of 5 meter diameter of larger (large furnaces) can be fed commercial scrap such as heavy melting Number 1 or No. 2, plate and structural scrap, and any equivalent sized scrap. Medium sized furnaces, between 3 to 5 meter diameter, should be fed a mix of shredded, sheared, and commercial scrap.

Direct reduced iron is normally prepared in the form of lumps or pellets, which are generally of a size of less than about one half inch diameter. Direct reduced iron briquets can also be used as feed material. Preferably such direct reduced iron is produced at a contiguous plant.

Scrap, direct reduced iron, slag formers and alloying materials are preheated and continuously fed to the electric arc furnace. A foaming slag practice is used, and the furnace is only partially tapped intermittently without removal of the electrodes, thus electrodes remain at full power during both continuous feeding, refining (which is continuous) and tapping (which is intermittent). Tapping is carried out by limited tilting of the furnace, generally not varying more than 15° from the vertical.

SUMMARY OF THE INVENTION

The present invention is a method for the continuous refining of steel, comprising the steps of preparing iron-bearing scrap for use in shredded, sheared or granular form; segregating the prepared scrap; preheating iron-bearing scrap, direct reduced iron, or a mixture thereof, and feeding the same to an electric powered steelmaking furnace for melting and refining therein; feeding slag formers to the steelmaking furnace; introducing carburizers into the steelmaking furnace; heating the charge electrically to melt the charge and from a molten metal bath within the furnace with a molten slag layer on the molten metal bath; maintaining the slag in a foaming condition during the steelmaking process; continuously feeding metallics, slag formers, and carburizers to the furnace; maintaining full electric power to the furnace at all times during the charging, melting and refining operations; and tapping the furnace while continuously feeding the furnace.

OBJECTS OF THE INVENTION

It is the principal object of this invention to provide a method for the continuous operation of an electric steel making furnace.

It is also an object of this invention to provide a means for preheating charge materials to an electric furnace.

It is another object of this invention to provide a continuous electric steelmaking process with good controls over both quality and product chemistry.

It is another object of this invention to provide a method of tapping an electric furnace while maintaining full electric power.

It is another object of this invention to provide a method of operating an electric furnace which will improve the load factor of the furnace and its acceptance as an energy user.

It is also an object of this invention to provide means for continuously melting hot direct reduced iron from a contiguous direct reduction plant.

BRIEF DESCRIPTION OF THE DRAWINGS

The foregoing and other objects will become readily apparent by reference to the following detailed description and the appended drawings, in which.

DETAILED DESCRIPTION

Figure 1:
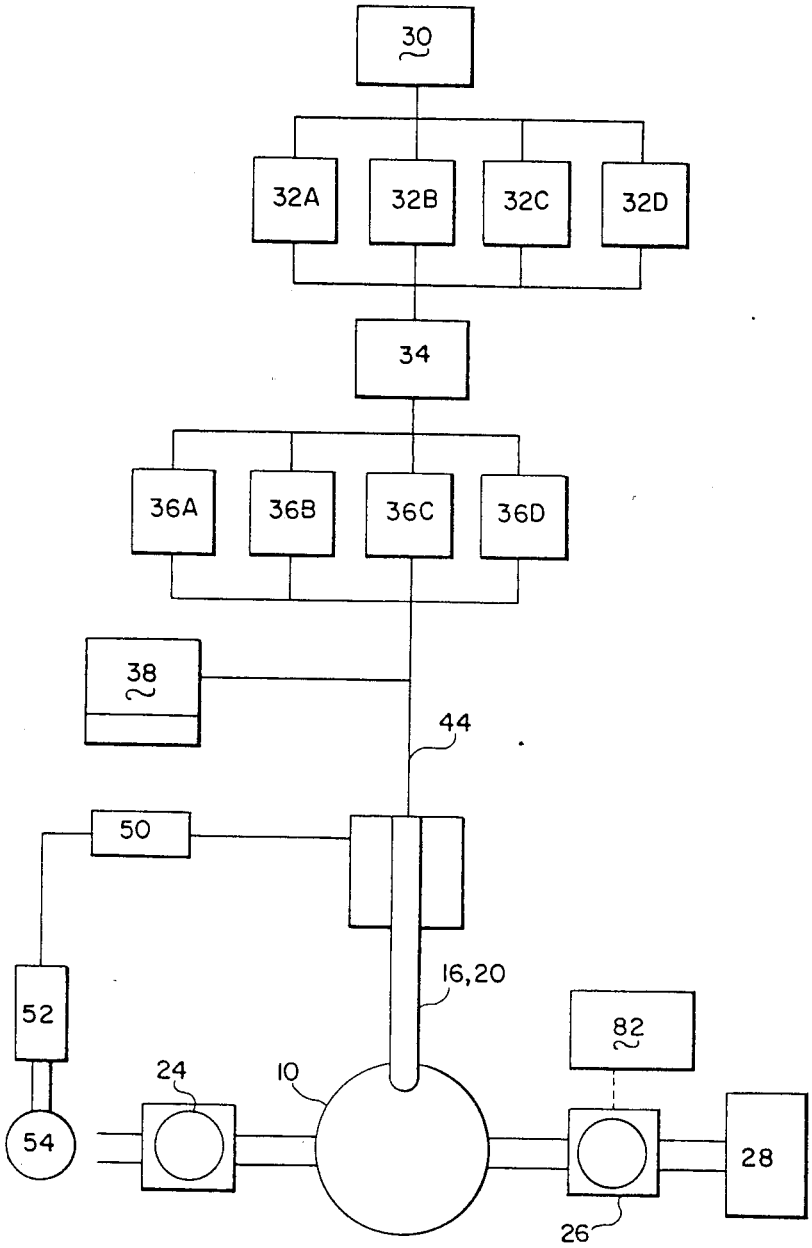
FIG. 1 is a schematic diagram of the steps in the operation of the invented process.
Figure 2:
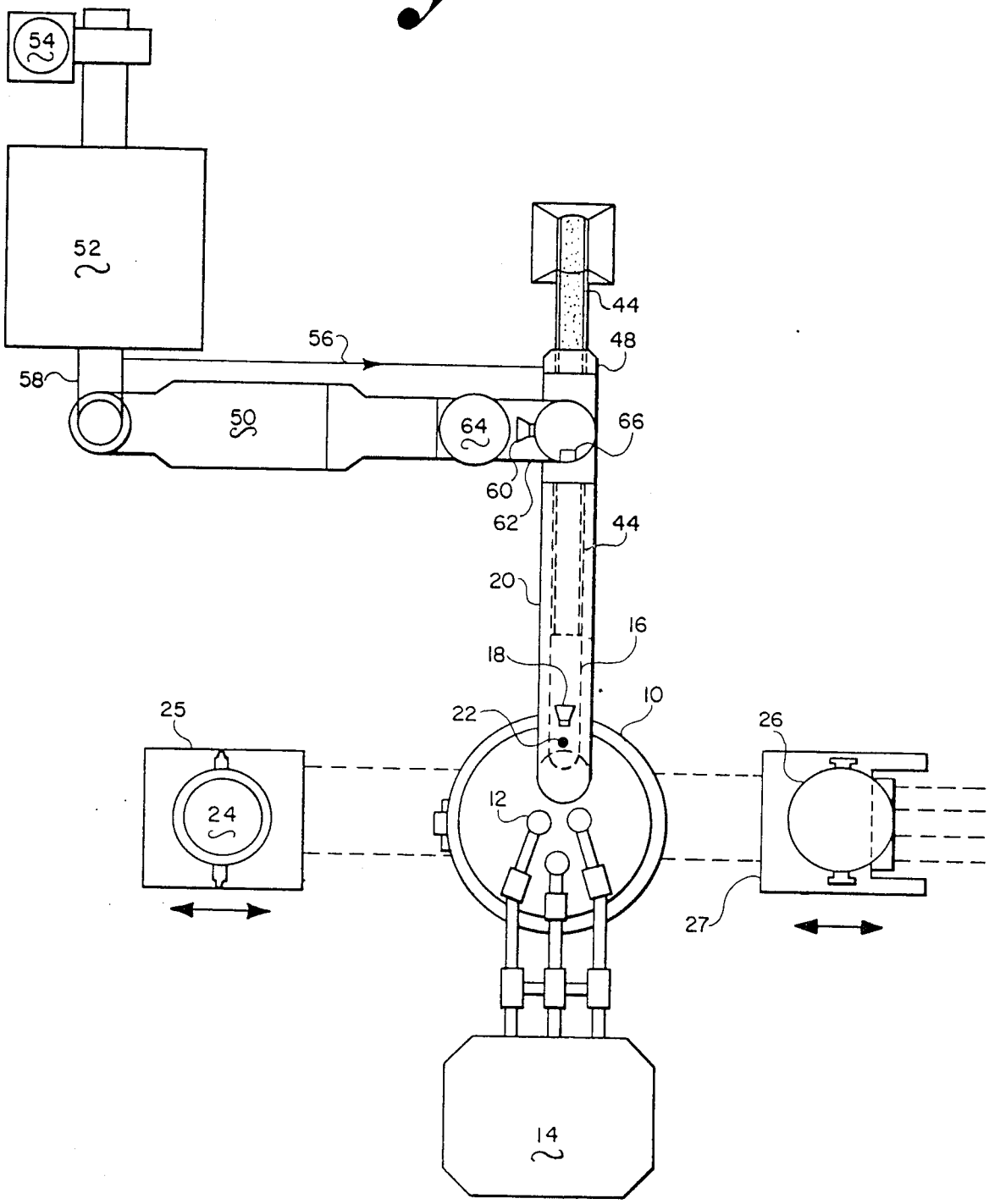
FIG. 2 is a schematic plan view of an electric arc furnace and all associated equipment as described in the present invention.

Referring now to the drawings, an electric arc steelmaking furnace 10 has three electrodes 12 protruding downwardly into the furnace. These electrodes are powered by a transformer (or power source) 14. A covered conveyor 44, preferably a vibrating channel, is provided for introducing charge materials, both metallics and nonmetallics, into the furnace.

A chute 16, following the conveyor 44, is also covered and contains a burner 18, for preheating the charge material and burning off combustible matter. The chute is preferably a water cooled channel. The conveyor 44 is covered by a segmented refractory 20 to form a passageway for off-gases from the furnace, which passageway acts as a preheating tunnel or preheating zone.

An oxygen sensor 22 is located within or at the exit of the tunnel 20 to determine the amount of oxygen in the off-gas passing through the tunnel, to allow the operation to maintain the off-gas reducing in characted, and avoid reoxidation of the feed. For deslagging purposes, a slag pot 24 is provided on a railmounted transfer car 25 for moving into and out of slagging position, and for tapping purposes, a steel ladle 26 is also provided on a transfer car 27 for moving into and out of tapping, ladle metallurgy, and pouring positions. The ladle can be teemed directly into a continuous caster 28.

Raw material handling equipment includes scrap receiving station 30, scrap segregation areas or bins 32A, 32B, etc., and a mobile crane for charging raw materials to a shredder or shear 34. The shredder/shear 34 discharges onto a conveyor which transfers the small segregated scrap to corresponding segregated scrap storage areas 36A, 36B, etc. DRI and/or pig iron are stored in area 38. A second crane is provided for charging material from storage areas 36 and 38 onto a conveyor 44. As mentioned above, scrap shredding and shearing is required only for small furnaces. The conveyor enters the tunnel 20 through a dynamic gas seal 48. Gas handling equipment is connected to the tunnel near gas seal 48.

The hot off gas treating system includes a connection to the tunnel, a boiler 50, bag house 52, stack 54, and associated piping. Pipe 56 connecting the gas pipe 58 between the boiler and bag house provides seal gas for the gas seal at the tunnel entrance. A burner 60 in gas passageway 62 heats and melts particulates within the gas which then precipitate into slag pit 64. An oxygen sensor 66 is provided within the gas off-take from the tunnel to determine the fuel-air ratio required by burner 60 for complete combustion of the off-gas.

The furnace 10, although shown as a three phase electric arc furnace, alternatively can be a direct current electric furnace, a plasma furnace or an induction furnace. The preferable type of induction furnace would be the channel induction furnace. Modern electric furnace components should be employed, including an interchangeable crucible or a split shell, water-cooled furnace wallpanels and a water-cooled furnace roof.

Heretofore, no tapping practice would allow continuous melting over a continuous 24-hour period. The present invention allows continuous charging and refining with full power to the furnace by tilting the furnace no more than 15° for deslagging and tapping. To allow continuous operation at full power, with the electrodes remaining in contact with the bath, and without damage to the furnace bottom, a molten metal heel is maintained within the bath having approximately the same volume as that of the molten metal removed by each tapping, or each heat. That is, a molten metal heel or approximately 40 to 50% of the maximum bath height should be retained after tapping.

Figure 3:
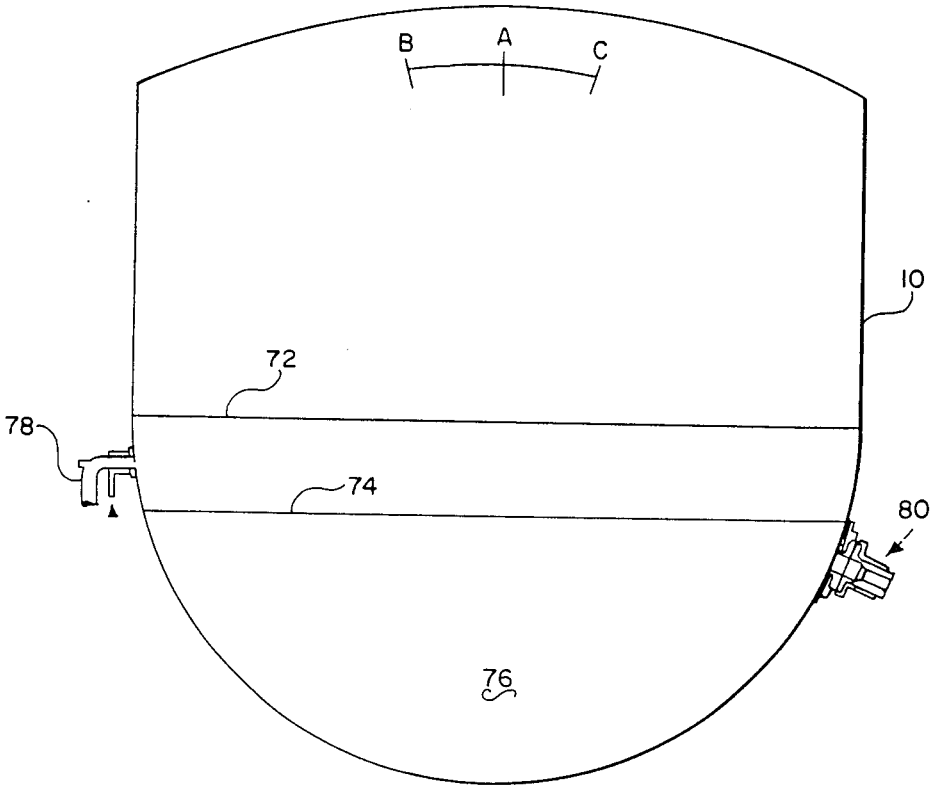
FIG. 3 is a schematic cross-section of an electric arc furnace as described herein.

Steelmaking furnace 10 is shown in FIG. 3. The maximum bath level elevation is indicated by bath line 72 and the minimum elevation of the bath is shown at bath line 74. The molten metal heel 76 constitutes that portion of the bath beneath the minimum bath line 74. One or more underbath tuyeres or blowing nozzles 78 are provided in the furnace beneath the bath line 72. A tapping device pouring arrangement 80 is also provided in the furnace wall at any desired location beneath the minimum bath line 74. This location prevents the removal of slag from the furnace through the tapping device during tapping.

The charge feed positions relative to the furnace are indicated at the top of the furnace in FIG. 3. In the normal operating position, charge material is fed at position A. During the tapping operation, the charge material is fed at position B, which represents a 15° tilt of the furnace. Although both the deslagging opening and the tapping opening can be on the same side of the furnace vessel, FIG. 3 shows that the vessel can be tilted in the opposite direction of tapping for slagging, wherein the feeding position would be as indicated at C.

The invented process can employ any of a variety of tapping or pouring devices or techniques, including the classic tap-hole, lip pouring, slide gate, and others.

Charge material for continuous melting is ferrous scrap, pig iron and direct reduced iron in pellet or briquet form. Scrap is separated by grades of purity, shredded or sheared to suitable size, if necessary, for continuous feeding into the furnace and stored by grade until required for feeding. Pig iron is granulated or broken into appropriate size for feed stock.

Charge material is selected from the stored shredded or sheared material and other feed stock, weighed and fed onto a conveyor. Preferably, the charge material is weighed on a weighing conveyor. The charge material is preheated in tunnel 20 by passing furnace off-gas through and over it, counter-current to the flow of the charge into the furnace. An oxygen sensor 22 indicates whether the off-gas is sufficiently reducing in character to prevent oxidation of the charge, and controls the adjustment of burners within the tunnel. If necessary, a reducing flame is used in the tunnel. Non-metallic combustible matter in the charge is burned off and the charge is heated to a maximum temperature of approximately 800° to 1000° C. (1500° to 1830° F.). The burner 18, positioned at the end of chute 20, provides the additional heat necessary to raise the charge temperature to the desired range for introduction to the furnace of 800° to 1000° C. (1500° to 1830° F.).

The steelmaking furnace operates continuously at full power for an extended period of time up to approximately six or seven days during which time no repairs are made to the furnace. After this time the furnace is shut down and the entire crucible or the upper part of the split shell is replaced.

The furnace is operated with a heel of molten metal approximately equal in weight to the tonnage removed at each tapping. This protects the bottom of the furnace from high power input during and immediately after tapping.

The charging, or feed, rate is determined by the desired temperature fluctuation of the bath. As tapping time is approached, the feed rate to the furnace is decreased for a few minutes before tapping. By reducing the chilling effect of the charge on the bath, the bath temperature is increased to the desired tapping temperature.

Slag is kept in the forming condition during all phases of the process, including the tapping phase, and full power is maintained to the furnace during tapping. Foaming slag is caused by the liberation of CO and $CO_2$ within the slag. The carbon necessary for reaction with the oxygen (oxide) in the charge is injected into the slag or slag-metal interface of the bath in the form of powdered carbon or coke through one or more underbath tuyeres 78 (see FIG. 3). If there is insufficient oxygen present in the bath, oxygen can also be injected through underbath tuyeres to effect the necessary reaction with carbon to promote a foaming slag. Carbon and/or oxygen may be injected into the bath at any time.

Dephosphorization, oxidation, partial desulfurization, and carburization are carried out within the furnace. However, deoxidation, final desulfurization, and alloying are accomplished in the ladle after tapping, by a process known as ladle metallurgy, such additions being made from ladle metallurgy area 82. The steel in the ladle is free of molten slag, and alloying elements can be added during the tapping procedure when common steel grades are being produced. Slag formers are added while gas is bubbled through the steel to promote homogeneity and cleanliness.

In order to tap the furnace, it is tilted up to 15° from the normal vertical position. The furnace can be tapped by any desired tapping technique, but it is preferably tapped through a slideable gate controlled pouring hole arrangement. This allows provision for preventing the presence of molten slag in the ladle.

Carbon, lime, oxygen or foamy slag formers may be injected via a replaceable injector nozzle or tuyere 78 beneath the molten metal bath level or into the slag-metal interface.

An example of the operation of the invented process is as follows:

EXAMPLE

The steel enthalpy at a tapping temperature of 1660° C. (3020° F.) is about 347,000 Kcal/metric ton (1.26 million BTU/short ton). By charging 100% scrap, with a normal oxygen consumption of about 10 $Nm^3$ per metric ton (318 scf/short ton), with no burners and no preheating, the electric energy consumption, in an 80 ton/heat furnace, is about 520 Kwh/ton. Additional heat developed within the furnace (due to heat of reaction, electrode oxidation, combustion of combustibles in scrap, etc.) is about 190,000 Kcal/metric ton (655,000 BTU/short ton) or the equivalent of 217 Kwh/metric ton.

Water cooling of the furnace evacuates about 63,000 Kcal/metric ton of steel or 73 Kwh (220,000 BTU or 64 Kwh/short ton) and the slag requires around 60,200 Kcal/metric ton or 70 Kwh (211,300 BTU or 62 Kwh/short ton). Thus, about 160 Kwh or 137,600 Kcal/metric ton (537,000 BTU or 141 Kwh/short ton) are available from the off-gas to preheat the feedstock or charge materials.

The enthalpy of one metric ton of steel scrap at 900° C. (1652° F.) is about 160,200 Kcal or 186 Kwh (562,300 BTU or 164 Kwh/short ton) and the heat transfer efficiency is about 40% for preheating of the charge. The total heat requirement is then 400,500 Kcal/metric ton (1.4 million BTU/short ton).

The net heat required, taking into account the available heat from the furnace off-gas, is 400,500−137,600=262,900 Kcal/metric ton (923,000 BTU/short ton) or about 31 $Nm^3$ of natural gas per metric ton (975 scf/short ton).

The energy required to melt the preheated charge and superheat the molten metal bath to the tapping temperature of 1660° C. (3020° F.) is 520−-(186/0.78)=282 Kwh/metric ton (253 Kwh/short ton).

When hot direct reduced iron is used as the feedstock, natural gas consumption is decreased.

From the foregoing it is clear that I have invented a method for the continuous operation of an electric steelmaking furnace, with means for preheating charge materials, charging and tapping while maintaining full electric power, and having good control over both quality and product chemistry.

What is claimed is:

1. A method for the continuous refining of steel, comprising:
   - segregating iron-bearing scrap according to its composition;
   - preheating said scrap;
   - feeding said iron-bearing scrap, direct reduced iron, or a mixture thereof to an electric powered steelmaking furnace for melting and refining therein;
   - feeding slag formers to the steelmaking furnace;
   - introducing carburizers into the steelmaking furnace;
   - heating the charge electrically to melt the charge and form a molten metal bath within the furnace with a molten slag layer on said molten metal bath;
   - maintaining said slag in a foaming condition during the steel making process;
   - continuously feeding metallics, slag formers, and carburizers to said furnace;
   - maintaining full electric power to said furnace at all times during the charging, melting and refining operations; and
   - tapping said furnace while continuously feeding said furnace.

2. A method according to claim 1 wherein the iron-bearing scrap is in shredded, sheared or granular form.

3. A method according to claim 1 wherein hot reacted gases are formed in said furnace, and said hot gases are passed through and over said scrap to preheat the scrap and to burn out the non-metallics in the scrap.

4. A method according to claim 1 wherein said slag is maintained in a foaming condition.

5. A method according to claim 4 wherein said foaming slag condition is promoted by injection of particulate carbon into the bath beneath the surface of the bath.

6. A method according to claim 5 wherein said foaming slag condition is promoted by injection of particulate carbon into the bath at the interface of slag and molten metal.

7. A method according to claim 1 wherein the temperature of the molten metal bath is maintained between 1540° and 1660° C. during the tapping operation.

8. A method according to claim 1 where the molten metal bath temperature is maintained in a range of about 1540° to 1590° C. during the melting period.

9. A method according to claim 1 wherein the bath composition is monitored periodically and the segregated feed material is selected and fed into said molten metal bath according to the quality requirements of the desired finished steel product.

10. A method according to claim 1 wherein said slag formers and carburizers are injected beneath the surface of the molten bath.

11. A method according to claim 10 wherein said slag formers and carburizers are injected through a tuyere beneath the surface of the molten bath at the slag-metal interface.

12. A method according to claim 1 wherein slag formers are selected from the group comprising powdered lime, fluorite, alumina, carbon, and iron oxide.

13. A method according to claim 1 wherein the temperature of said bath is increased immediately prior to tapping.

14. A method according to claim 13 wherein said bath temperature is increased by injection of oxygen into said molten bath.

15. A method according to claim 1 wherein said bath temperature is decreased immediately after tapping.

16. A method according to claim 15 wherein said bath temperature is decreased by increasing the feeding rate of charge materials.

17. A method according to claim 1 wherein approximately half of said molten metal bath is removed by tapping, and the remainder is retained in said furnace as a heel for receiving continuously charged feedstocks, whereby the lining of the furnace bottom is protected.

18. A method according to claim 1 wherein said tapping operation is accomplished by lip pouring.

19. A method according to claim 1 wherein the furnace is tapped through a tapping device at or beneath the slag metal interface and wherein said tapping operation is accomplished by tilting the furnace no more than 15° to pour through the tapping device.

20. A method according to claim 19 wherein said tapping operation is controlled by a sliding gate.

21. A method according to claim 11 further comprising changing the tuyere while the furnace is in the tilted position, whereby no delay in process operation is experienced because of the tuyere replacement procedure.

22. A method according to claim 3 further comprising monitoring reacted gases to assure that such gases are non-oxidizing in character.

23. A method according to claim 20 further comprising tilting the furnace up to 15° opposite to the tapping direction and changing a sliding gate while the furnace is in such position, whereby no metal or slag can escape during the gate-change operation.

* * * * *